US007735540B2

(12) United States Patent
Armstrong

(10) Patent No.: US 7,735,540 B2
(45) Date of Patent: Jun. 15, 2010

(54) LONGITUDINAL FRAME MEMBER AND SPLINE

(75) Inventor: Laurence P. Armstrong, Weyerhaeuser, WI (US)

(73) Assignee: FreshAir Screen Technology, LLC, Weyerhaeuser, WI (US)

( * ) Notice: Subject to any disclaimer, the term of this patent is extended or adjusted under 35 U.S.C. 154(b) by 258 days.

(21) Appl. No.: 11/760,231

(22) Filed: Jun. 8, 2007

(65) Prior Publication Data

US 2007/0256800 A1 Nov. 8, 2007

Related U.S. Application Data

(63) Continuation-in-part of application No. 11/233,640, filed on Sep. 23, 2005, now abandoned, and a continuation-in-part of application No. 10/825,525, filed on Apr. 15, 2004, now Pat. No. 7,316,758.

(60) Provisional application No. 60/885,426, filed on Jan. 18, 2007, provisional application No. 60/615,794, filed on Oct. 4, 2004, provisional application No. 60/485,579, filed on Jul. 9, 2003, provisional application No. 60/492,698, filed on Aug. 6, 2003.

(51) Int. Cl.
*E06B 9/24* (2006.01)

(52) U.S. Cl. ..... 160/328; 160/371; 160/280

(58) Field of Classification Search ..... 160/327, 160/328, 380, 354, 371; 52/222; 24/556, 24/499, 489, 464
See application file for complete search history.

(56) References Cited

U.S. PATENT DOCUMENTS 584,148 A * 6/1897 Robinson ..... 160/381
875,552 A 12/1907 McGee
1,235,735 A 8/1917 Steffan et al.
1,484,382 A 2/1924 Allitt
2,709,489 A * 5/1955 Keebler ..... 160/381
2,784,781 A 3/1957 Rhoades
3,220,469 A * 11/1965 Oehmig ..... 160/380
3,379,237 A 4/1968 Worthington
3,552,476 A 1/1971 Le Tarte
4,279,061 A * 7/1981 Santo ..... 24/72.5
4,472,862 A 9/1984 Bloomfield et al.
4,662,038 A 5/1987 Walker (Continued)

OTHER PUBLICATIONS

Office Action for U.S. Appl. No. 11/233,640, filed Feb. 4, 2008.

(Continued)

*Primary Examiner*—Blair M. Johnson
(74) *Attorney, Agent, or Firm*—Carlson, Gaskey & Olds, P.C.

(57) ABSTRACT

A frame includes longitudinal members secured to one another. The longitudinal members support a spline that is normally open in a first position to provide a cavity. A fabric, such a mesh screen, is arranged over the frame so that the perimeter of the screen is received within the cavities of the longitudinal members. A movable platen is actuated to engage the spline. The splines are forced into the cavities to a second position in which the perimeter of the screen is pinched between the splines and the longitudinal members. A radius nose of the splines is retained in a channel of the longitudinal members securing the screen without tearing it when under load.

19 Claims, 6 Drawing Sheets

U.S. PATENT DOCUMENTS 4,765,039 A 8/1988 Rowlands et al.
4,788,806 A * 12/1988 Sease ..... 52/222
4,805,330 A 2/1989 Bubernak
4,986,034 A 1/1991 Mozuras et al.
5,039,246 A 8/1991 Woodruff et al.
5,380,120 A 1/1995 Vermeulen
5,485,705 A 1/1996 Guillemet
6,945,305 B1 * 9/2005 Limauro ..... 160/369

OTHER PUBLICATIONS

Office Action for U.S. Appl. No. 11/233,640, filed Jul. 9, 2008.

* cited by examiner

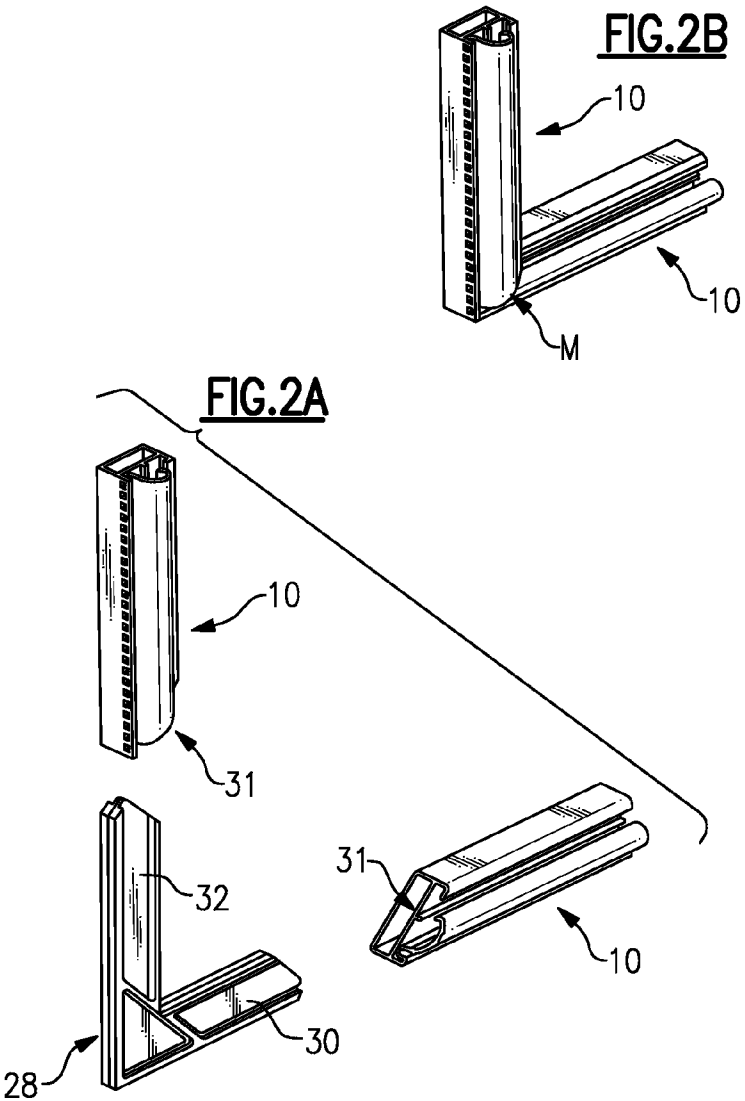
FIG.2B
10
10
M
FIG.2A
10
31
10
31
30
32
28
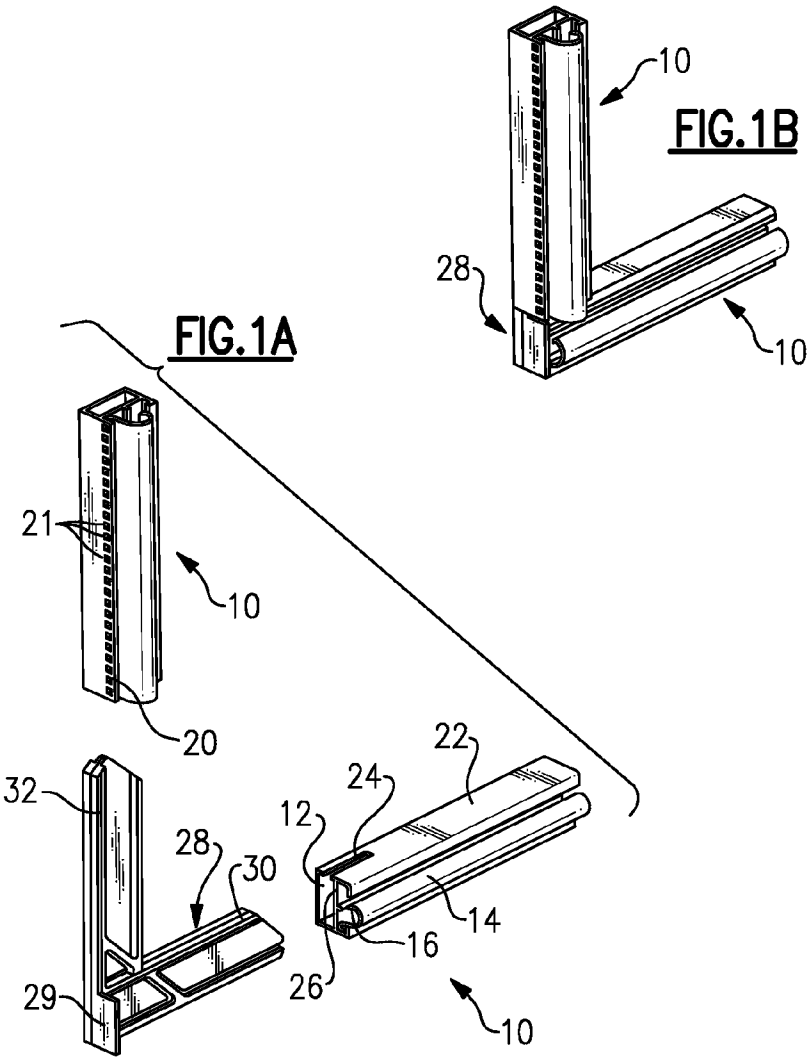
FIG.1B
10
10
28
FIG.1A
10
20
21
22
14
16
24
12
26
10
30
28
32
29

LONGITUDINAL FRAME MEMBER AND SPLINE

This application claims priority to provisional application No. 60/885,426 filed on Jan. 18, 2007. This application is also a continuation-in-part of application Ser. No. 11/233,640 filed on Sep. 23, 2005, now abandoned which claims priority to provisional application No. 60/615,794 filed on Oct. 4, 2004, and a continuation-in-part of application Ser. No. 10/825,525 filed on Apr. 15, 2004, now U.S. Pat. No. 7,316,758 which claims the benefit to provisional application Nos. 60/485,579 and 60/492,698 respectively filed on Jul. 9 and Aug. 6, 2003.

BACKGROUND

This application relates to a longitudinal frame member and spline for use in attaching fabric, for example, to a frame.

Frames used for windows, doors and office furniture, such a cubical dividers, have fabric attached to a frame in some fashion. Other applications include ceiling panels, air/water filter panels, and acoustic tiles. In the example of window frames and doors using screens, typically the frame includes longitudinal frame members having channels to which the screen is secured. The longitudinal members are joined to one another in some fashion to provide the frame. During assembly, the screen is positioned over the frame and a rubber spline having a generally circular cross section is inserted into the channels thereby retaining the screen between the spline and longitudinal frame members. Other approaches have been used to secure the screen to the frame. Typically, a separate retaining member is pressed or snapped into the frame, securing the screen between the frame and retaining member. However, manipulating and inserting a separate retaining member, like a rubber or plastic spline into the frame members while controlling the woven fabric, is labor intensive and costly.

Installation of fabric using the spline arrangement described above or other manners of screen attachment are typically labor intensive and costly. In the example of the splines described above, a special tool having rollers must be run along the length of longitudinal member. Moreover, the frame tends to "hourglass" as a result of the screen assembly process. Pre-bowing the frame members and blocking of the assembled frame for squareness is typically used to prevent this undesired result, which adds cost to assembly.

Another approach for securing screens has been to use a hinged retaining member integral with and movable relative to the frame, as disclosed in U.S. Pat. No. 3,379,237. The arrangement disclosed in the '237 patent has at least two problems. First, the frame is not structurally stable such that it will deflect and permit the retaining member to open, thus releasing the screen. Second, the retaining member does not keep sufficient force on the screen to maintain the screen in tension. Third, there is a sharp edge on the retaining member that is the primary and only point of engagement with the screen, which will tend to tear the screen when force is applied to it.

Window and door screens must pass an industry "push out" test. One industry standard requires that the screen be held through the longitudinal frame members for at least forty pounds of applied force. The standard can sometimes be difficult to meet using rubber or plastic splines.

What is needed is an improved frame that requires less labor and cost to manufacture while meeting or exceeding the present industry standard for "push out" and improving the hour glass specifications.

These and other features of the disclosure can be best understood from the following specification and drawings, the following of which is a brief description.

BRIEF DESCRIPTION OF THE DRAWINGS

FIG. 1A is an exploded view of a frame including longitudinal frame members with square ends.

FIG. 1B is a perspective view of the frame of FIG. 1A shown assembled.

FIG. 2A is an exploded view of a frame including longitudinal frame members with mitered ends.

FIG. 2B is a perspective view of the frame of FIG. 2A shown assembled.

SUMMARY

Figure 3A:
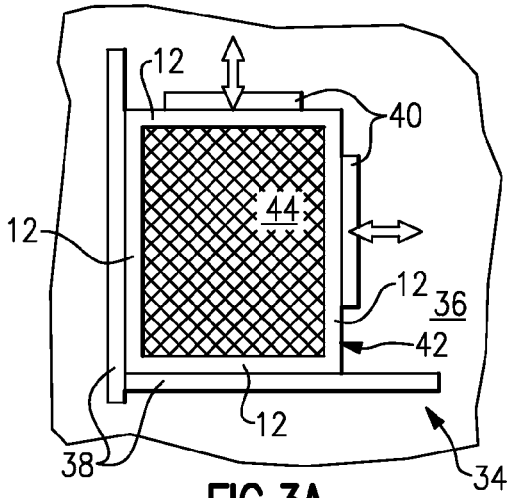
FIG. 3A is a top elevational view of an example manufacturing process for the frame.

An example frame of the disclosure includes longitudinal members secured to one another, for example by using corner locks, to form the frame. The longitudinal members support an integral spline that is normally open prior to assembly to expose a cavity that receives a fabric. A fabric, such a mesh screen, is arranged over the frame so that the perimeter of the screen is received within the cavities of the longitudinal members.

In one example, the frame is retained on a fixed platen by stops. A movable platen is actuated to engage the spline. The splines are forced into the cavities or channels to a closed position in which the perimeter of the screen is pinched between a nose of the spline and the longitudinal members. The nose provides three engagement features, in one example, that ensure that screen is securely retained without tearing it. The first engagement feature is provided by a curved portion of the nose that engages and pushes the screen down into the cavity as the spline is moved from the open to the closed position. The second engagement features is provided by a corner of the nose that pinches the screen against a base wall of the channel. The third engagement feature is provided by a ridge that extends from the base wall to support the perimeter of the screen so that it wraps about the corner thereby enhancing retention. The spline profile is designed to deflect about a fulcrum hinge point away from the engagement features of the surrounding frame to prevent the frame from distorting during assembly.

The spline is generally S-shaped in one example. The spline may be integral with the longitudinal member or separately secured to the longitudinal member, for example, by snapping or sliding the spline into a recess in the longitudinal member.

Accordingly, the disclosed frame requires less labor and cost to manufacture while meeting or exceeding the present industry standard for "push out." Further, the frame members do not require pre-bowing or blocking during the assembly process.

DETAILED DESCRIPTION

An example longitudinal frame member 10 is shown in the Figures. Like numerals are used to refer to like elements between some Figures.

Referring to FIGS. 1A-2B, a rigid frame is constructed from structure including the longitudinal frame member 10, which provides a tubular portion 12, for example, and a spline 14. The tubular portion 12 is quadrangular in shape in one example. The longitudinal frame member 10 provides a channel 26 that receives a portion of the spline 14 to securely retain the screen to the member 10, which will be discussed in more detail below.

The example member 10 shown in FIGS. 1A-3B is roll formed out of a sheet of metal so that the spline 14 is formed integrally with the longitudinal frame member 10. In other examples, the longitudinal frame member 10 and spline 14 are extruded plastic, aluminum or fiberglass (FIGS. 11A-13). In other examples, the spline 14 can be separately secured to the longitudinal frame member 10, which may be wood or aluminum, to form an integrated structure (FIG. 6), or the plastic spline 14 can be extrused onto the member 10 (FIGS. 14A-15).

Figure 4:
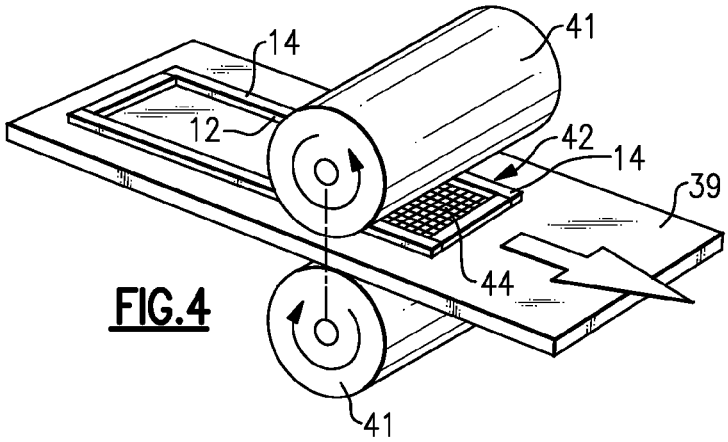
FIG. 4 is a perspective view of another example manufacturing process for the frame.

For roll-formed members, the member 10 includes a first edge 16 provided on the spline 14 and a second edge 18 provided on the tubular portion 12, best seen in FIG. 4. The integral tubular and spline portions 12 and 14 are secured to provide a desired cross-sectional shape by forming a flange 20, which is shown in FIGS. 1A and 4. The flange 20 may include a series of indentations 21 formed by a roller to further secure the metal in the desired shape, best shown in FIG. 1A. In one example, the member 10 is constructed from a suitable metal that is either roll formed and/or extruded. A plastic or other material may also be used.

Opposite the flange 20 is a wall 22 having a slot 24 for receiving a corner lock 28. The corner lock 28 includes first and second legs 30 and 32. The first leg 30 is received in the tubular portion 12, and the leg 32 extends from the slot 24.

The arrangement shown in FIGS. 1A and 1B depicts longitudinal frame members 10 that have square ends. In such an arrangement, it may be desirable to provide an end cap 29 on the corner lock 28. Referring to FIGS. 2A and 2B, the longitudinal frame members 10 include mitered ends 31 that may provide for a more aesthetic mitered joint M and also eliminate the need for slot 24.

Referring to FIG. 3A, a machine 34 is disclosed for securing a fabric 44, such as screen, to be the longitudinal frame members 10. It should be understood that "fabric" is intended to include woven and non-woven materials, which also includes flexible membranes. The members 10 are assembled using the corner lock 28, for example, or any other suitable method of attachment, to provide a frame 42. The frame 42 is arranged on a fixed platen 36 having fixed stops 38. Movable stops 40 are actuated to secure the frame 42 against the fixed stops 38. The arrangement of stops 38 and 40 enables any size frame 42 to be accommodated on the machine 34.

Another example assembly process is shown in FIG. 4. The frame 42 is supported on a movable surface 39. The surface 39 and frame 42 are passed between opposing rollers 41, which closes the spline 14 over the fabric 44 thus securely retaining the fabric 44 relative to the tubular portion 12.

Figure 3B:
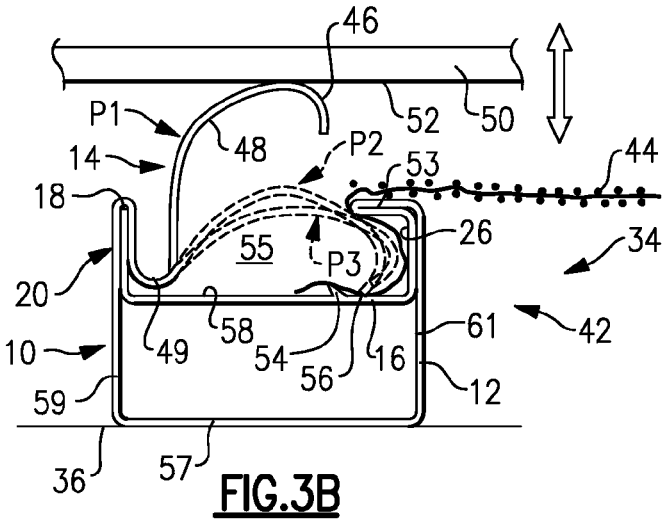
FIG. 3B is a cross-sectional view of the frame having a screen installed.

According to one example method of assembly, referring to FIG. 3B, the fabric 44 is positioned on top of the frame 42 with the spline 14 in a first position P1. A cavity or channel 55 is provided between the spline 14 and the tubular portion 12 in the first position P1 for receiving the fabric 44. The spline portion includes a nose 46 having the first edge 16. The nose 46 extends to an arch 48 having an adjoining spring portion 49 opposite the nose 46. In the example shown in FIG. 3B, the spring portion 49 is integral with the tubular portion 12. In the example embodiment, the nose 46 has a smaller radius than the gradual radius of the arch 48. The spring portion 49 has a smaller radius than the nose 46. The spring portion 49 biases the spline 14 upward and away from the tubular portion 12 to an open position.

The machine 34 includes a movable platen 50 having a flat profile 52. By utilizing a flat profile 52, the tooling costs are drastically reduced since a platen of particular profile requiring machining is not required, and alignment issues between the movable platen 50 and frame 42 are eliminated.

Figure 6:
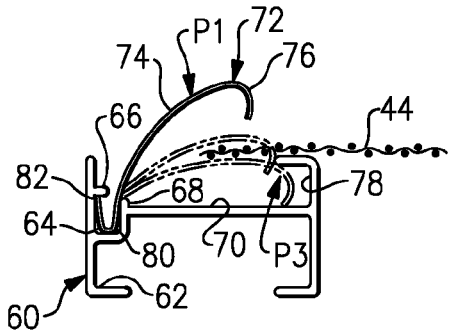
FIG. 6 is a cross-sectional view of another example of the longitudinal frame member.

The tubular portion 12, or base portion, is generally quadrangular in one example and includes a base wall 58 that provides a bottom surface of the channel 26. The base wall 58 extends between and interconnects spaced apart first and second outer walls 59, 61, in one example. In the example shown in FIG. 3B, a bottom wall 57 interconnects the first and second outer walls 59, 61 to provide an enclosed space, which receives the legs 30, 32 of the corner locks 28. The example shown in FIG. 6 depicts a bottom wall 57 with a gap that exposes the space provided by the tubular portion 12. The tubular member provides structural stability to the spline 14 so that it is not forced open once the fabric 44 has been installed. The first outer wall 59 extends outwardly away from the base wall 58 to support the spring portion 49. The second outer wall 61 extends outwardly away from the base wall 58 to provide the flange 53.

The movable platen 50 is moved downward into engagement with the spline 14 moving the spline 14 from the first or open position PI (see also FIGS. 11A and 11B) to a second position P2 (see also FIG. 11C), which forces the perimeter of the fabric 44 into the channel 26. The curved portion of the nose 46 provided a first engagement feature that pinches the fabric 44 against a flange 53 to stretch the fabric. In one example, the edge of the flange 53 is rounded to prevent the fabric 44 from tearing as the nose 46 pushes the fabric 44 into the channel 26. The arch 48 extends above the flange 53 that, in part, provides the channel 26 along with a surface 58 of the tubular portion 12. The movable platen 50 continues to move downward moving the spline 14 from the second position P2 to the third or closed position P3 (see also FIG. 13). In the position P3, the nose 46 is forced further into the channel 26 securely retaining the perimeter of the fabric 44. The radius nose 46 prevents the fabric 44 from tearing as force is applied to it. The flexible spline 14 deflects without yielding.

The nose 46 has a sharp corner 56, for example, on the first edge 16 that pinches the fabric 44 to retain the perimeter of the screen between the corner 56 and the surface of the base wall 58, thus providing a second engagement feature. The corner 56 not likely to tear the fabric 44 as force is applied to it since the fabric at this location will experience a smaller force that at the first engagement feature. In the third position P3, the arch 48 has a larger radius than it did in first position P1, and the nose 46 has smaller radius than it did in the first position P1. The deflected spline 14 applies sufficient retaining force on the fabric 44 to prevent "push-out" of the fabric. The fabric 44 begins to tear, which occurs at around 125 pounds of applied force for typical insect screen materials, without it pulling out of the channel 26.

Figure 5:
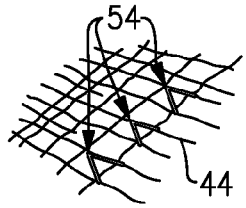
FIG. 5 is a perspective view of barbs used to improve retention of the screen.

To further improve retention of the fabric 44, a third engagement features, such as barbs 54, may extend upward from the base wall 58 into the channel 26, as is show in FIG. 5. The fabric 44 at the third engagement feature experiences an even smaller force than at the second engagement feature.

FIG. 6 depicts another example longitudinal frame member 60, which is extruded. The longitudinal frame member 60 includes a tubular portion 62 having a separate spline portion 72. The tubular portion 62 provides a recess 64 having a protrusion 66 and fulcrum 68. A spring portion 80 of the spline portion 72 is inserted into the recess 64, and an edge 82 is retained by the protrusion 66. The spring portion 80 acts against the fulcrum 68 when moving between the first, second and third positions P1, P2 and P3. Similar to the embodiment described in FIG. 4, the spline portion 72 includes an arch 74 and nose 76. The nose 76 is forced into the channel 78 by the movable platen 50. The fabric 44 is retained between the nose 76 and surface 70.

Figure 8:
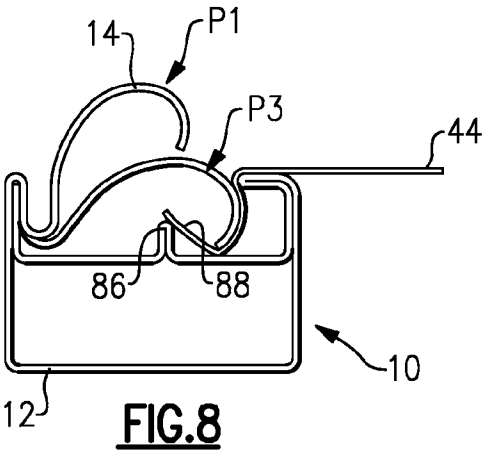
FIG. 8 is a cross-sectional view of a longitudinal frame member similar to FIG. 3B with a ridge.
Figure 7:
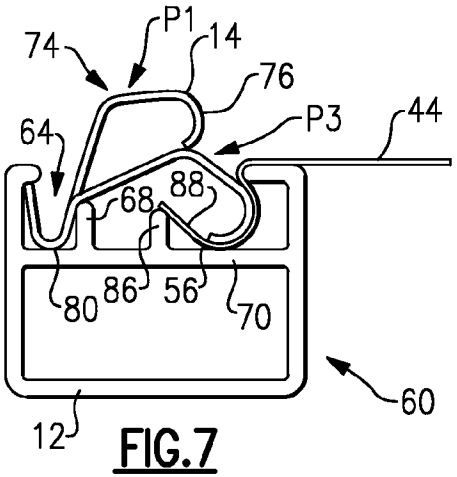
FIG. 7 is a cross-sectional view of a longitudinal frame member similar to FIG. 6 with a ridge.

Referring to FIG. 7, the spring portion 80 is retained in the recess 64. The arch 74 may or may not include an apex, depending upon the geometry of the spline 14 and tubular portion 12. The fulcrum 68 extends from the surface 70. A ridge 86, which provides a third engagement feature, also extends from the surface 70 to lift an edge portion 88 of the fabric 44 away from the surface to better ensure that the corner 56 engages and holds the screen 44. The ridge 86 is also shown for roll-formed longitudinal frame members 10 in FIG. 8, and at 186 and 210 respectively in FIGS. 11B and 14B.

Figure 9:
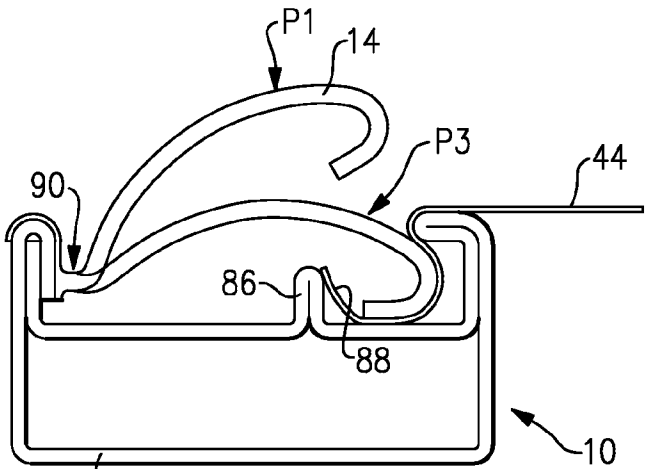
FIG. 9 is a cross-sectional view of a longitudinal frame member similar to FIG. 8 with a spline overmolded to a tubular portion of the frame member.
Figure 11C:
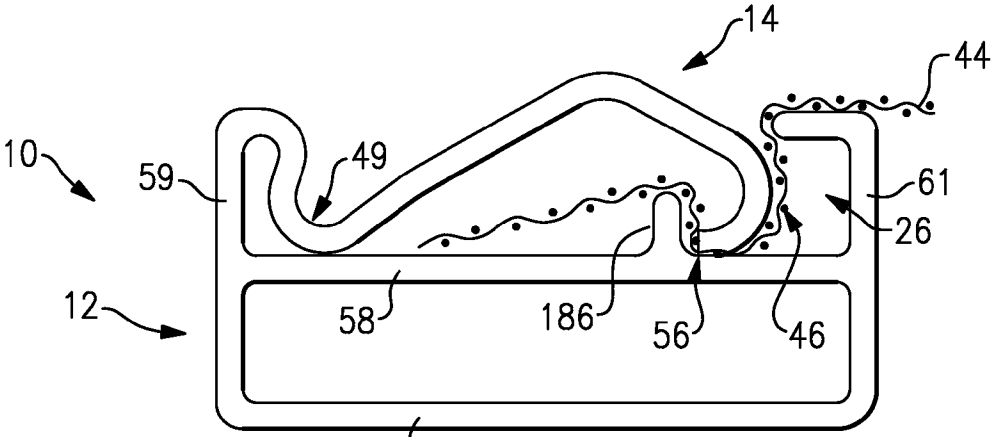
FIG. 11C is a cross-sectional view of the longitudinal frame member shown in FIG. 11B with the spline in a closed or bottomed position.
Figure 11A:
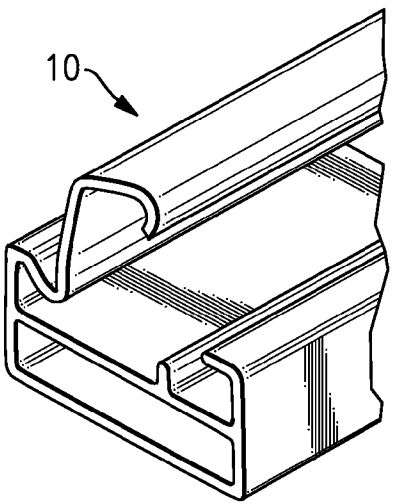
FIG. 11A is a perspective view of another example longitudinal frame member.
Figure 11B:
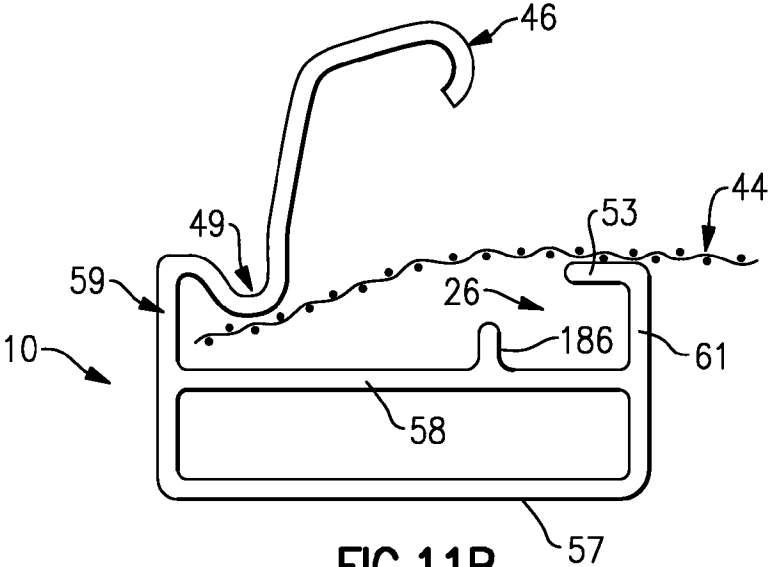
FIG. 11B is a cross-sectional view of the longitudinal frame member shown in FIG. 11A with a screen prior to assembly.
Figure 12:
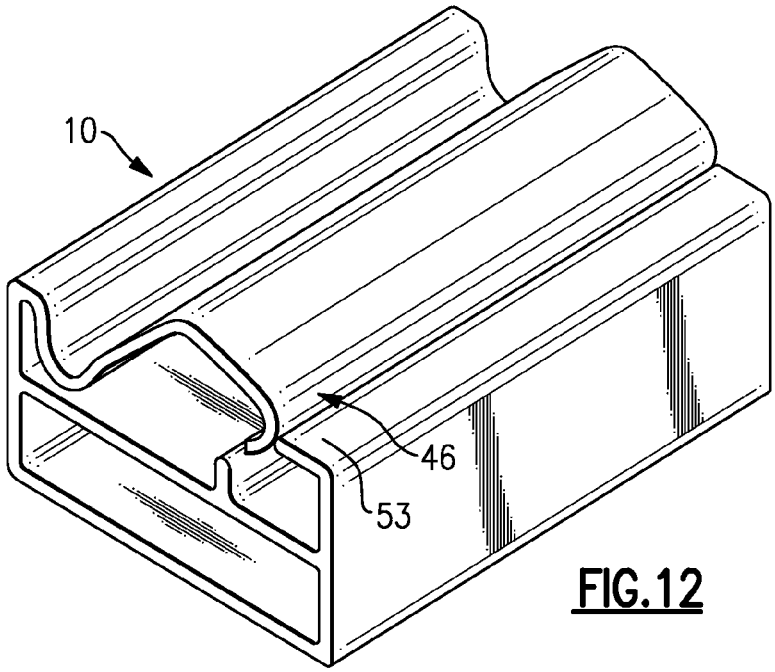
FIG. 12 is a perspective view of the longitudinal frame member shown in FIG. 11A in a transitional or interference position.
Figure 13:
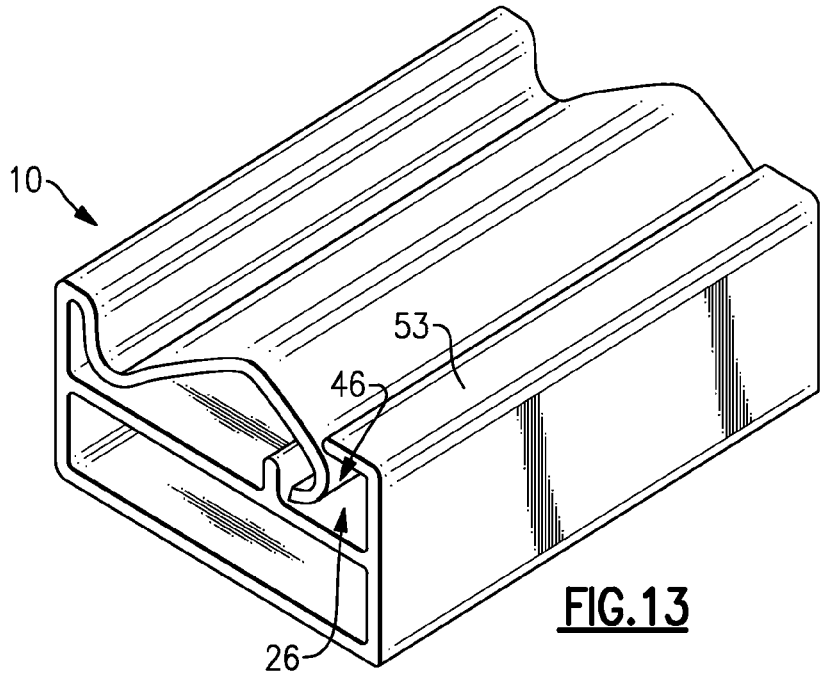
FIG. 13 is a perspective view of the longitudinal frame member shown in FIG. 11C in the closed or bottomed position, but without the screen.

In another example, the spline 14 can be adhered to the tubular portion 12 by any suitable process, such as by laminating or over-molding, as shown in FIG. 9.

The example longitudinal frame member 10 permits easy replacement of the screen. The spline 14 may be "zippered" open and the damaged screen removed and replaced. With the new screen positioned as desired, the spline 14 can be manually forced back into the channel 26 using a block of wood and hammer or a roller, for example.

Figure 10:
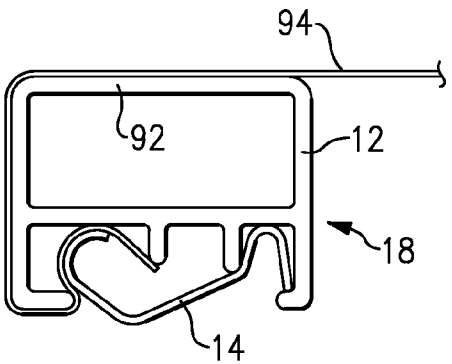
FIG. 10 is a cross-sectional view of the longitudinal frame member wrapped in a decorative fabric.

FIG. 10 depicts the inventive longitudinal frame member 10 for furniture or other applications in which it is desirable to conceal the tubular member 12. A decorative fabric 94 is wrapped around a side 92 other than the side that supports the spline 14. In another example, the member 10 is a sanding block, and the fabric 94 is an abrasive material such as sandpaper or sanding screen. For a sanding block, a spline 14 is provided at each end of the block to retain opposing ends of the sandpaper.

Figure 14B:
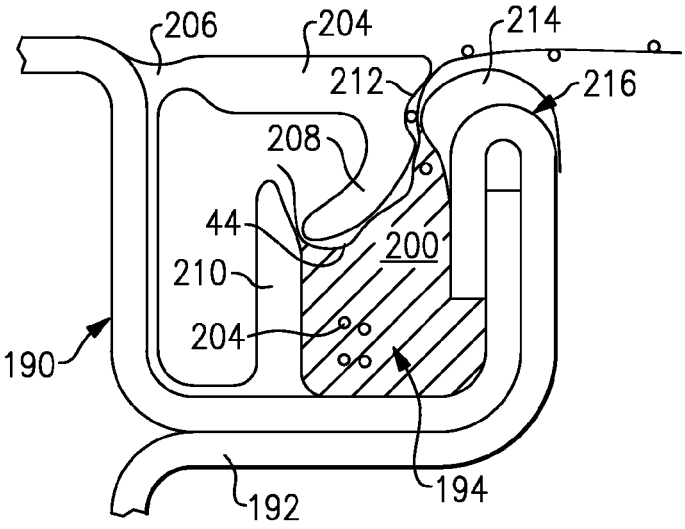
FIG. 14B is a cross-sectional view of a longitudinal frame member shown in FIG. 14A with the spline in a closed position retaining a screen.
Figure 15:
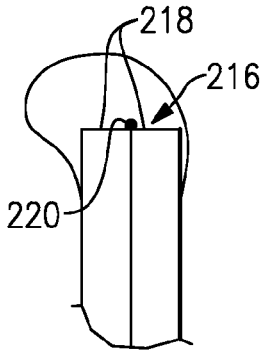
FIG. 15 is an enlarged cross-sectional view of another example construction of an end of the longitudinal frame member.
Figure 14A:
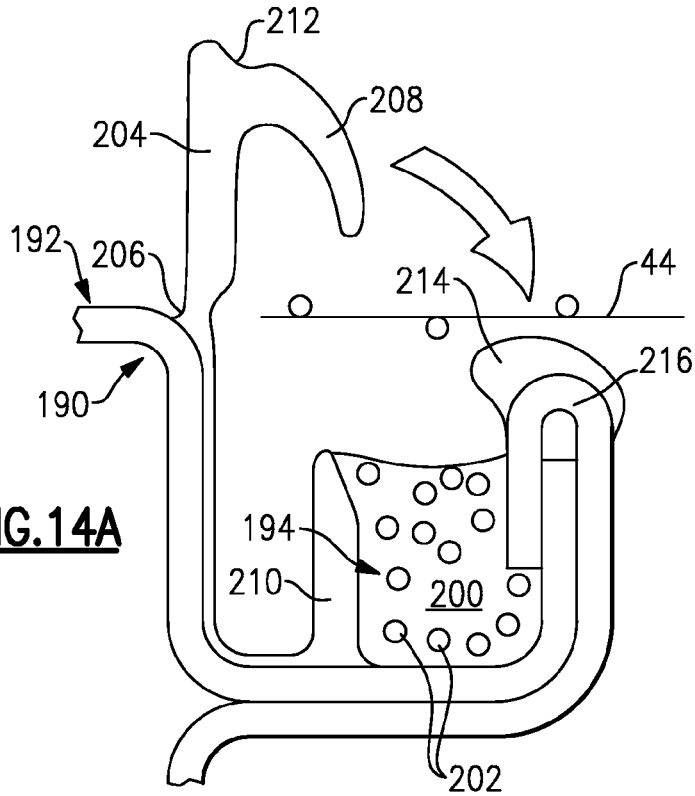
FIG. 14A is a cross-sectional view of a longitudinal frame member with a bi-laminate plastic extrusion spline.

Referring to FIGS. 14A and 14B, the frame 190 includes a frame member 192 having the channel 194. The frame member 192 includes a flange portion having a flange 204 connected to the tubular portion of the frame member 192 by a living hinge 206. The flange 204 includes a hook portion 208 having a recess 212 cooperating with a protrusion 214 arranged on an end 216 of the channel 194. An intermediate wall 210, or ridge, may be arranged in the channel 194 to form a cavity 200 that is filled with adhesive 202. The flange 204, intermediate wall 210, and protrusion 214 are, for example, santoprene molded onto the frame member 192. The edge of the fabric 44 is arranged between the flange 204 and protrusion 214. The flange 204 is forced downward by an upwardly tapering surface 197 of the truck assembly 196. The hook portion 208 positions the edge of the fabric 44 in the adhesive 202, and the fabric 44 is additionally retained between the protrusion 214 and recess 212 of the hook portion 208. Applied heat from the heat source 198 actuates the adhesive 202.

As an alternative configuration to the end 216, edges 218 may be laser welded to one another using a weld bead 222 to form the end 216 shown in FIG. 15.

The example embodiments have been described in an illustrative manner, and it is to be understood that the terminology that has been used is intended to be in the nature of words of description rather than of limitation. Obviously, many modifications and variations of the disclosed examples are possible in light of the above teachings. For that reason, the following claims should be studied to determine their true scope and content.

What is claimed is:

1. A frame for supporting a fabric comprising:

a fabric; and a structure including a longitudinal member having a base wall, a first outer wall, and a flange projecting from the first outer wall, a channel formed between the base wall, the first outer wall, and the flange, and a spline pivotally attached to the longitudinal member about a pivot, the pivot fixedly attaching the spline to the longitudinal member and located opposite the channel, the spline including a U-shaped radius nose and an arch extending from the radius nose to the pivot, the pivot, arch and radius nose being a resilient continuous member;

wherein the spline is pivotable to a position in the channel such that the fabric is pinched between the radius nose of the spline and the base wall; and when the spline is in the closed position in the channel the radius nose is moved further into the channel upon application of a downward force to the convex side of the arch so as to stretch the fabric, movement of the arch in response to the downward force translating into movement of the radius nose.

2. The frame according to claim 1, wherein the longitudinal member and spline are provided by an extruded member.

3. The frame according to claim 1, wherein the longitudinal member provides a generally tubular base portion that includes a second outer wall extending from and beyond a base wall which defines at least a portion of the channel, the spline adjoining the second outer wall.

4. The frame according to claim 3, wherein the tubular base portion has a generally quadrangular shape that is substantially unchanged in an open position and the closed positions, the first outer wall extending beyond the quadrangular shape.

5. The frame according to claim 4, wherein the first outer wall extends from and beyond the quadrangular shape and is spaced from the second outer wall, the first and second outer walls adjoining the base wall, and the radius nose cooperating with the first outer wall to maintain the spline in the closed position.

6. The frame according to claim 5, wherein the quadrangular shape includes a bottom wall spaced from the base wall, the bottom and base walls interconnected by the first and second outer walls to provide a substantially enclosed space.

7. The frame according to claim 5, wherein the quadrangular shape includes a bottom wall spaced from the base wall, the bottom and base walls interconnected by the first and second outer walls to provide a space, the bottom wall including a gap exposing the space.

8. The frame according to claim 1, wherein the spline includes a spring portion that provides a fulcrum about which the radius nose pivots between the open and closed positions.

9. The frame according to claim 8, wherein a recess is provided by the longitudinal member opposite the channel, the spring portion arranged opposite the radius nose and received in the recess.

10. The frame according to claim 1, wherein the radius nose includes a curved portion and a corner, the curved portion arranged near the flange to provide a first engagement feature, and the corner arranged near the base wall to provide a second engagement feature, the fabric stretched by the radius nose between the first and second engagement features.

11. The frame according to claim 10, wherein the base wall includes a ridge extending there from toward the spline, the ridge lifting an edge portion of fabric away from the base wall to provide a third engagement feature, the fabric pinched between the corner and the base wall at the second engagement feature.

12. The frame according to claim 11, wherein the fabric is pinched between the curved portion and the flange at the first engagement feature.

13. The frame according to claim 11, wherein the flange includes a curved edge provided at the second engagement feature.

14. The frame according to claim 8, wherein the spring portion extends in a first direction to an arch, and the radius nose extending from the arch in a second direction that is generally opposite the first direction and toward the spring portion.

15. The frame according to claim 14, wherein the arch and radius nose provide a generally C-shaped unitary member, and wherein the arch includes a curved apex protruding away from the longitudinal member.

16. The frame according to claim 15, wherein the spring portion, arch and the radius nose provide a generally S-shaped unitary member.

17. The frame according to claim 16, wherein the spring portion is generally U-shaped.

18. A method of securing a fabric to a frame comprising the steps of:

a) providing a spline with an arch between a pivot and a radius nose thereof;

b) providing the spline in a first position opened relative to a structure, the arch and the radius nose each having a radius when the spline is in the first position;

c) providing fabric between the structure and the spline when the spline is in the first position;

d) rotating the spline about the pivot from the first position to a second position where the spline is provided in a channel of the structure;

e) providing that the radius nose of the spline secures the fabric to the structure when in the second position; and f) applying a downward force to the arch when the spline is in the second position thereby moving the spline to a third position such that the radius of the arch is larger when the spline is in the third position than when the spline is in the first position, and the radius of the radius nose is smaller when the spline is in the third position than when the spline is in the first position.

19. A structure for supporting a fabric comprising:

a longitudinally extending member including a cavity and an adjoining channel, which is provided by a surface and a flange spaced from the surface; and a fixedly attached to the member and spline pivotally supported relative to the member at a location opposite the flange, the spline including a first position in which the spline is spaced from the flange providing access to the cavity, the spline including an arch extending from the location and having a first radius in the first position, and a U-shaped nose extending from the arch and having a second radius in the first position, both the first and second radii providing a concave surface facing the cavity, the first radii being a different size than the second radii, the arch and nose being a continuous, resilient member, the nose retained in the channel in a second position in which the spline is received within the cavity with at least one of the arch and the nose engaging the flange and the nose engaging the surface.

* * * * *